US007536838B2

(12) United States Patent
Whittlesey et al.

(10) Patent No.: US 7,536,838 B2
(45) **Date of Patent: *May 26, 2009**

(54) CLIPPERS WITH TRANSLATING GATE MEMBERS AND COOPERATING STIFFENER ASSEMBLIES AND RELATED METHODS

(75) Inventors: Thomas E. Whittlesey, Apex, NC (US); Kim L. Poling, Fuquay-Varina, NC (US); William M. Poteat, Fuquay-Varina, NC (US)

(73) Assignee: Tipper Tie, Inc., Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/950,736

(22) Filed: Dec. 5, 2007

(65) Prior Publication Data

US 2008/0083195 A1 Apr. 10, 2008

Related U.S. Application Data

(63) Continuation of application No. 11/682,425, filed on Mar. 6, 2007, now Pat. No. 7,322,164.

(60) Provisional application No. 60/781,101, filed on Mar. 10, 2006.

(51) Int. Cl.
*B65B 51/04* (2006.01)

(52) U.S. Cl. ..... 53/417; 53/138.4; 29/243.56; 452/48

(58) Field of Classification Search ..... 53/417, 53/138.1–138.4; 29/243.56, 243.57; 452/48; *B65B 51/04*
See application file for complete search history.

(56) References Cited

U.S. PATENT DOCUMENTS 2,831,302 A 4/1958 Jensen et al.
3,293,736 A 12/1966 Tipper
3,389,533 A 6/1968 Tipper et al.
3,401,499 A * 9/1968 Jahnke ..... 53/138.4
3,455,010 A * 7/1969 Busler ..... 29/243.57
3,499,259 A 3/1970 Tipper et al.
3,583,056 A * 6/1971 Klenz ..... 29/243.57
3,717,972 A * 2/1973 Niedecker ..... 53/138.4

(Continued)

FOREIGN PATENT DOCUMENTS

EP 0352825 1/1990

(Continued)

OTHER PUBLICATIONS

International Preliminary Report on Patentability, PCT/US2007/005991, International filing date Mar. 8, 2007, Date of Mailing Sep. 25, 2008.

(Continued)

*Primary Examiner*—Stephen F Gerrity
(74) *Attorney, Agent, or Firm*—Myers, Bigel, Sibley & Sajovec, P.A.

(57) ABSTRACT

Embodiments of the present invention provide translating gates having at least one cooperating stiffener assembly and related, apparatus, systems, methods and computer program products. The translating gates with at least one stiffener assembly may be particularly suitable for non-pivoting clippers, such as, for example, stationary-mount clippers. The stiffener assembly can be configured to stiffen, brace and/or otherwise keep the gate assembly tightly closed during a clipping operation.

12 Claims, 9 Drawing Sheets

U.S. PATENT DOCUMENTS

| | | | | | |
|---|---|---|---|---|---|
| 4,043,011 | A | * | 8/1977 | Giraudi et al. | 29/243.57 |
| 4,085,779 | A | | 4/1978 | Wells | |
| RE30,196 | E | | 1/1980 | Velarde | |
| 4,218,861 | A | * | 8/1980 | Marz | 53/138.4 |
| 4,393,641 | A | * | 7/1983 | Niedecker | 53/138.4 |
| 4,675,945 | A | | 6/1987 | Evans et al. | |
| 4,683,700 | A | | 8/1987 | Evans et al. | |
| 4,766,713 | A | | 8/1988 | Evans | |
| 4,847,953 | A | | 7/1989 | Evans et al. | |
| 5,074,386 | A | | 12/1991 | Evans | |
| 5,077,955 | A | | 1/1992 | Evans | |
| 5,085,036 | A | | 2/1992 | Evans et al. | |
| 5,161,347 | A | | 11/1992 | May et al. | |
| 5,167,567 | A | | 12/1992 | Evans | |
| 5,203,760 | A | | 4/1993 | Chen et al. | |
| 5,209,041 | A | | 5/1993 | Evans | |
| 5,259,168 | A | * | 11/1993 | Evans et al. | 53/138.4 |
| 5,269,054 | A | | 12/1993 | Poteat et al. | |
| 5,495,701 | A | | 3/1996 | Poteat et al. | |
| 5,586,424 | A | | 12/1996 | Chen et al. | |
| 6,155,024 | A | * | 12/2000 | Bussey, III et al. | 53/138.4 |
| 6,298,635 | B1 | | 10/2001 | Bienert et al. | |
| 6,401,885 | B1 | | 6/2002 | Whittlesey | |
| 6,883,297 | B2 | * | 4/2005 | Kirk et al. | 53/138.2 |
| 7,322,164 | B2 | * | 1/2008 | Whittlesey et al. | 53/138.4 |
| 2005/0034426 | A1 | | 2/2005 | Griggs et al. | |
| 2005/0039419 | A1 | | 2/2005 | Griggs et al. | |

FOREIGN PATENT DOCUMENTS

| | | | | |
|---|---|---|---|---|
| EP | 1428760 | A1 | * | 6/2004 |
| EP | 1731432 | | | 12/2006 |

OTHER PUBLICATIONS

Tipper Tie brochure "Have it your way!" for model TCM 2250 (2 pages) (1994).

Tipper Tie brochure for Double Table Top Clipper Signature™ Series Model SZ32124 (believed prior to Mar. 10, 2006).

International Search Report and Written Opinion dated Sep. 6, 2007 for corresponding PCT application No. PCT/US2007/005991.

* cited by examiner

CLIPPERS WITH TRANSLATING GATE MEMBERS AND COOPERATING STIFFENER ASSEMBLIES AND RELATED METHODS

Related Applications

This application is a continuation of U.S. patent application Ser. No. 11/682,425 filed Mar. 6, 2007, which issued as U.S. Pat. 7,322,164, on Jan. 29, 2008, which claims the benefit of priority of U.S. Provisional Patent Application Ser. No. 60/781,101, filed Mar. 10, 2006, the contents of which arc hereby incorporated by reference as if recited in full herein.

FIELD OF THE INVENTION

The present invention relates to apparatus, systems, methods and computer program products that apply clips to packages.

BACKGROUND OF THE INVENTION

Conventionally, in the production of consumer goods such as, for example, meat or other food products, the food is fed (typically pumped) or stuffed into a casing in a manner that allows the casing to fill with a desired amount of the product. As is well-known, the casings can be a slug-type natural or artificial casing that unwinds, advances, stretches and/or pulls to form the elongate casing over the desired product. Another type of casing is a heat-sealed tubular casing formed by seaming a thin sheet of flexible material, typically elastomeric material, together. U.S. Pat. Nos. 5,085,036 and 5,203,760 describe examples of automated substantially continuous-feed devices suitable for forming sheet material or flat roll stock into tubular film casings. The contents of these patents are hereby incorporated by reference as if recited in full herein.

It is known to use edible collagen film to cover semi-solid sections of meat during processing to form a smoked meat product that gives the appearance of a solid meat muscle, such as a boneless ham. One example of a known prior art apparatus used to form a smoked meat product is the "TCM2250" pumpable model from Tipper Tie, Inc., located in Apex, N.C.

Clip attachment apparatus or "clippers" are well known to those of skill in the art and include those available from Tipper Tie, Inc., of Apex, N.C., including product numbers Z3214, Z3202, and Z3200. Examples of clip attachment apparatus and/or packaging apparatus are described in U.S. Pat. Nos. 3,389,533; 3,499,259; 4,683,700; and 5,161,347, the contents of which are hereby incorporated by reference as if recited in full herein.

A double clipper can concurrently apply two clips to the tails and leading portions of casings or "chubs". One clip defines the first end portion of the next package or chub and the other defines the trailing or second end portion of the package or chub then being closed. A cutting mechanism, typically incorporated in the clipper, can sever the two packages before the enclosed package is removed from the clipper apparatus. U.S. Pat. No. 4,766,713 describes a double clipper apparatus used to apply two clips to a casing covering. U.S. Pat. No. 5,495,701 proposes a clipper with a clip attachment mechanism configured to selectively fasten a single clip or two clips simultaneously. The mechanism has two punches, one of which is driven directly by a pneumatic cylinder and the other of which is connected to the first punch using a pin and key assembly. The pin and key assembly allows the punches to be coupled or decoupled to the pneumatic cylinder drive to apply one single clip or two clips simultaneously.

U.S. Pat. No. 5,586,424 proposes an apparatus for movement of U-shaped clips along a rail. The apparatus includes a clip feed for advancing clips on a guide rail and the arm is reciprocally driven by a piston and cylinder arrangement. The contents of each of these patents are hereby incorporated by reference as if recited in full herein.

Typical clippers pivot during operation from a home position to a clip position. Stationary mount clippers have also been used, such as, for example, the clipper used in an SAM 3E product sold by Tipper Tie, Inc. The SAM 3E product uses separate rotoactuators to close the gate during a clip cycle. However, the gate sometimes moves ("kicks") outward from a relatively tightly closed operative position, which can malform the clip being applied and/or generate an undesirably loose closure around the gathered portion of the casing. Other stationary clippers have used mechanical servo-driven cam systems. While potentially more resistant to machine/frame flexure, the mechanical systems may not allow sufficient dwell time after clipping and may be unable to form a desirably configured tight clip onto the product.

SUMMARY OF EMBODIMENTS OF THE INVENTION

Embodiments of the present invention provide translating gates having at least one cooperating stiffener assembly and related, apparatus, systems, methods and computer program products. The translating gates with at least one stiffener assembly may be particularly suitable for non-pivoting clippers, such as, for example, stationary-mount clippers. The stiffener assembly can be configured to stiffen, brace and/or otherwise keep the gate assembly tightly closed during a clipping operation.

Some embodiments are directed to translating gate assemblies that are adapted to cooperate with a clipper. The gate assemblies include: (a) a first gate member configured to translate between open and closed configurations; (b) a stiffener assembly attached to the first gate member, the stiffener assembly configured to translate between a retracted and extended configuration; (c) a first actuator attached to the stiffener assembly, wherein the first actuator is configured to automatically translate the stiffener assembly to the extended configuration whereby the stiffener assembly applies a force against the closed first gate member sufficient to inhibit outward movement of the first gate member from the closed configuration during a clipping operation; and (d) a second gate member with a second actuator configured to automatically translate between open and closed configurations, wherein when the first and second gate members are in the respective closed configurations, the first and second gate members meet to define a clip entry gate for clips delivered from an automated or semi-automated clipper.

In some embodiments, the first actuator can include an actuator rod that is pivotably attached to the stiffener assembly at a first location. The stiffener assembly can also be pivotably attached to the first gate member at a second lower location. In operation, the first gate member pivots from an upward open configuration to a downward closed configuration in response to translation of the first actuator rod.

Other embodiments are directed to clippers. The clippers include: (a) a clipper body having upper and lower portions and comprising a clip path that directs clips downward to a clip application window, wherein the clipper body is fixedly mounted to a frame to be substantially stationary; (b) a first gate member attached to the lower portion of the clipper body in communication with a first actuator, the first gate member configured to automatically translate between open and closed configurations; (b) a second gate member attached to the lower portion of the clipper body, attached to a second actuator, wherein when the first and second gate members are in the respective closed configurations, the first and second gate members meet to define a clip entry gate for clips delivered from the clipper body; and (c) a translating stiffener assembly configured to automatically translate between a retracted and extended configuration proximate the clip entry gate to cooperate with the first gate member. In the extended configuration, the stiffener assembly can inhibit outward movement of the first gate member from the closed configuration during a clipping operation.

In some embodiments, the first and second gate members are configured to automatically translate between open and closed configurations substantially in-concert. The first and second actuators include respective actuation rods and the stiffener assembly is attached to the first actuator and the first gate member so that translation of the first actuation rod automatically moves the stiffener assembly to the extended configuration, which forces the first gate member to travel to the closed configuration and applies a force with horizontal and vertical force vectors to the first gate member to inhibit outward movement of the first gate member from the closed configuration during a clipping operation.

In some embodiments the clipper includes a control module with a computer program product, the control module in communication with the first and second actuators for controlling the first and second actuators. The computer program product includes a computer readable storage medium having computer readable program code embodied in the medium. The computer-readable program code is configured to automatically direct the actuation of the first and second actuators to substantially synchronize the movement of the first and gate members, so that the open configuration is timed to coincide with the release of target articles and the closed configuration is timed to coincide with the capture of target articles to define the closed gate clip path for the clipper.

Other embodiments are directed to methods of clipping target articles using an automated or semi-automated clipper. The methods include: (a) linearly actuating a first actuator to direct a stiffener assembly to travel from a retracted to an extended configuration; (b) forcing a first gate member to pivot to a closed configuration (which may be carried out using a separate actuator or in response to the travel of the stiffener assembly); (c) actuating a second actuator to pivot a second gate member to a closed configuration, whereby the first and second gate members meet to define a clip gate for a clipper in the closed configuration; then (d) punching a clip from the clipper through the clip gate to wrap around a target product to attach a clip thereto. During the punching operation, the stiffener assembly cooperates with the first gate member to inhibit outward movement from the closed configuration.

These and other objects and/or aspects of the present invention are explained in detail in the specification set forth below.

DETAILED DESCRIPTION

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

In the description of the present invention that follows, certain terms are employed to refer to the positional relationship of certain structures relative to other structures. As used herein, the term "front" or "forward" and derivatives thereof refer to the general or primary direction that the filler or product travels in a production line to form an encased product; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the directions opposite, respectively, the forward and downstream directions.

The term "frame" means a generally skeletal structure used to support one or more assemblies, modules and/or components. The frame can be a floor mount frame. The term "automated" means that operations can be carried out substantially without manual assistance. The term semi-automatic means that operator input or assistance may be used but that most operations are carried out automatically using electromechanical devices and programmatically directed control systems.

Figure 1:
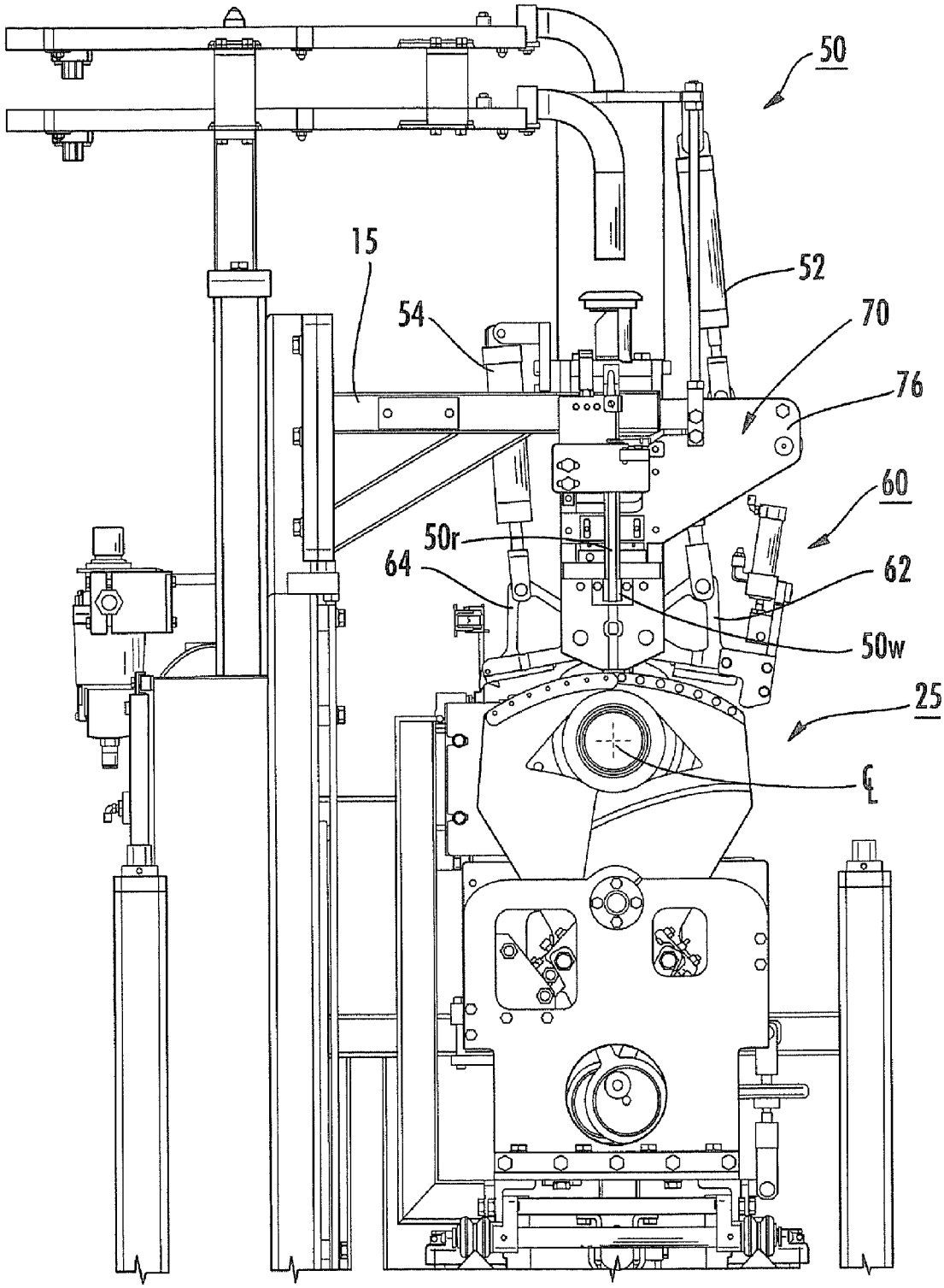
FIG. 1 is an end view of a clipper apparatus with a gate assembly in an open configuration according to embodiments of the present invention.
Figure 4A:
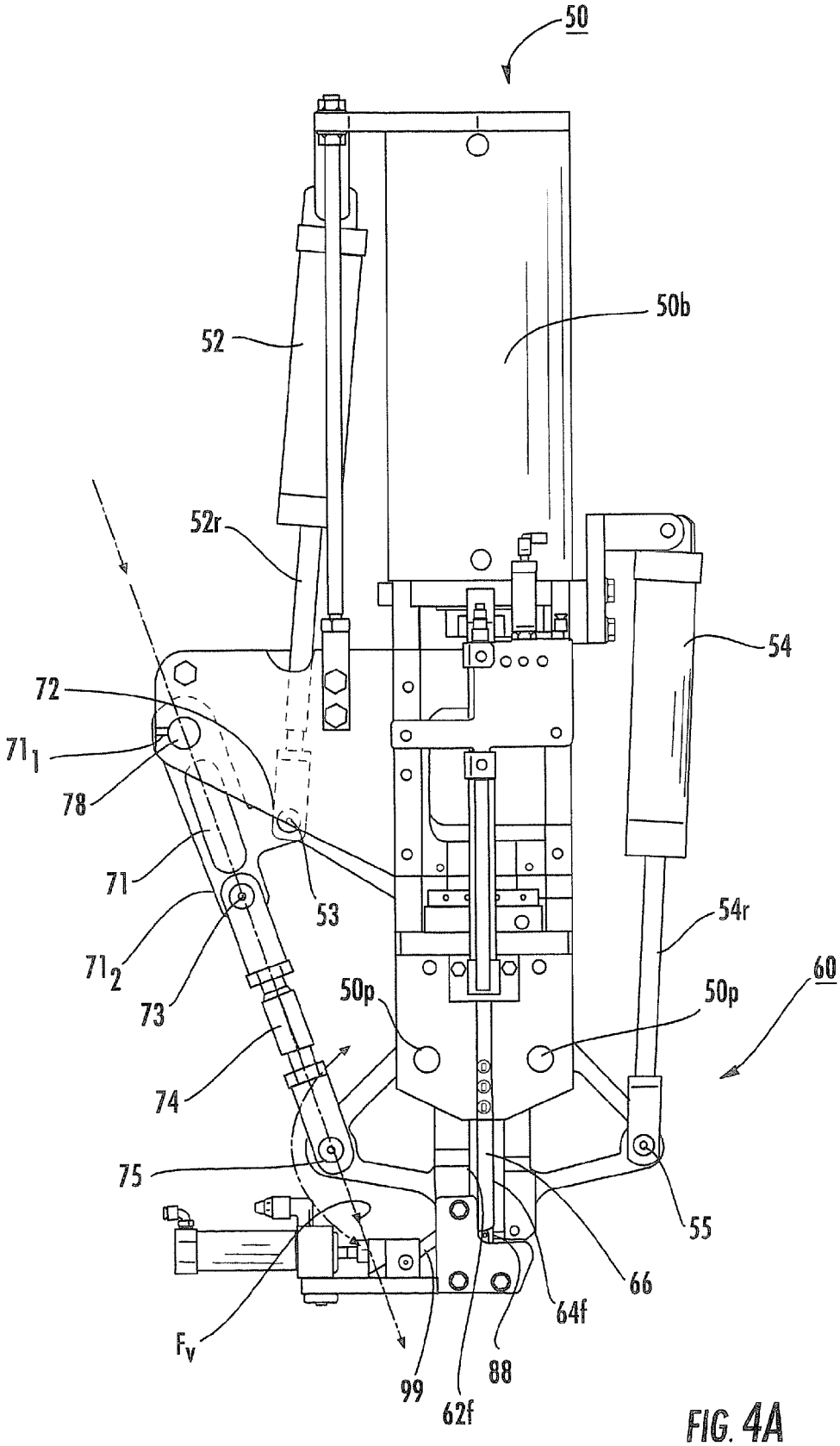
FIG. 4A illustrates the device shown in FIG. 3A with the translating gate assembly in an closed configuration, and with the mounting member shown as transparent to illustrate features of the stiffener assembly according to embodiments of the present invention.
Figure 4B:
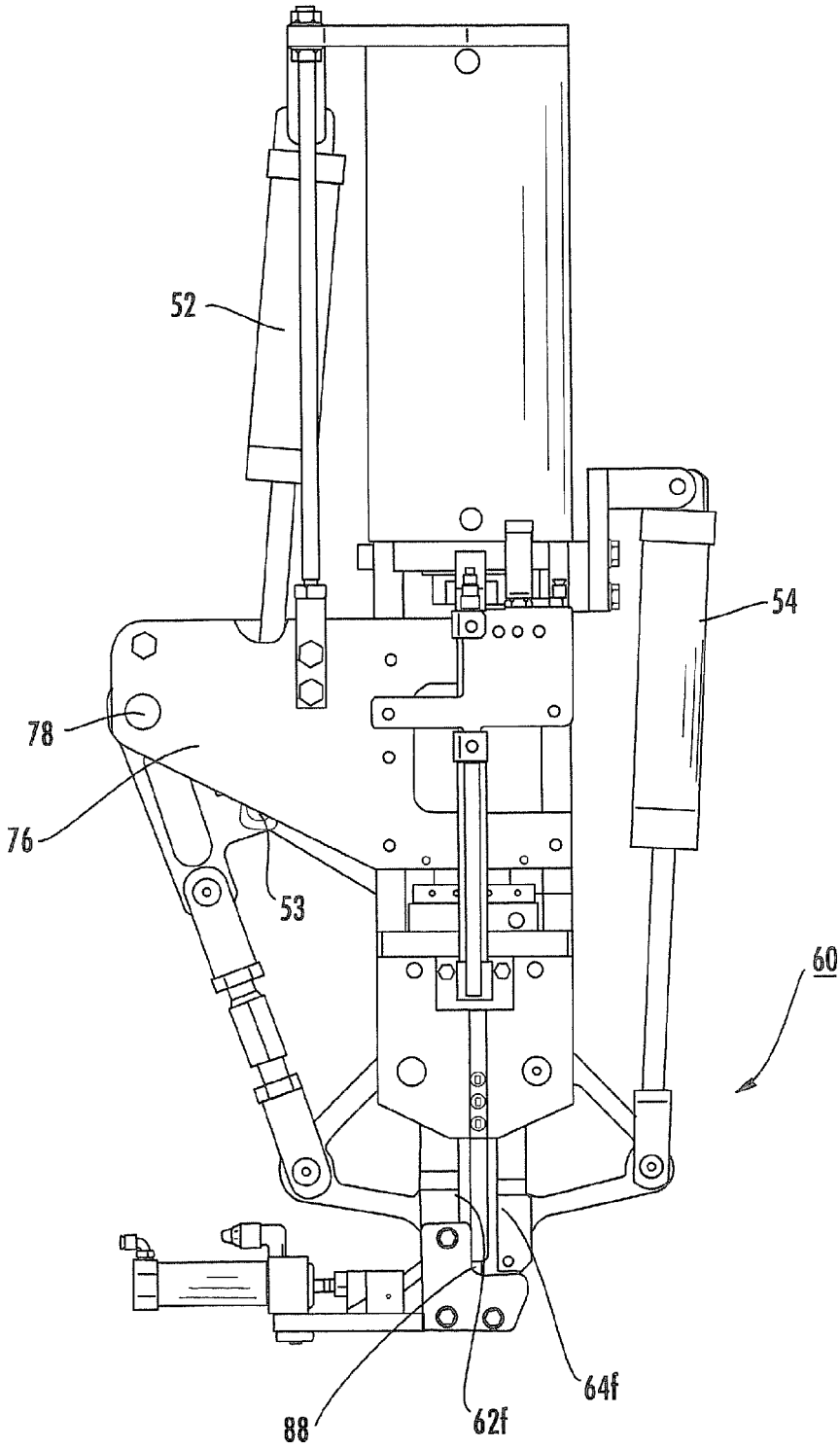
FIG. 4B illustrates the device of FIG. 4A in the closed configuration, but with the transparent mounting member shown in solid lines.

FIG. 1 illustrates a packaging apparatus 10 with a clipper 50 that is in communication with a voider assembly 25 and a gate assembly 60 with translating first and second gate members 62, 64 that close to meet and define a clip gate 66 (FIG. 4A). The voider assembly is configured to void (squeeze) excess product from an end of the package. The operation of the voider assembly 25 is well known to those of skill in the art. Each of the first and second gate members 62, 64 can be in communication with (directly or indirectly) a respective actuator 52, 54 with respective actuation rods 52*r*, 54*r*. The actuators 52, 54 are typically pneumatic actuators, although hydraulic or other actuators may also be used.

The frame 15 can hold the clipper 50. In some embodiments, the clipper 50 is a non-pivoting clipper. In particular embodiments, the clipper 50 is a stationary mount, non-moving device. In other embodiments, the clipper 50 may translate vertically.

As shown in FIG. 1, the gate assembly 60 (or clipper 50) also includes a stiffener assembly 70 that cooperates with at least one of the gates 62, 64 to structurally reinforce, stiffen, brace and/or lock the gate in the closed configuration to inhibit an outward "kick" and/or frame flexure during a clipping cycle. As shown, the stiffener assembly 70 is attached to the clipper 50 and the rod 52*r* and the first gate 25 assembly 62 is attached to the stiffener assembly 70. Thus, linear translation of the actuator 52 causes the stiffener assembly 70 to move, which causes the first gate member 62 to close. The stiffener assembly 70 then remains extended to structurally reinforce, brace, stiffen and/or lock at least one of the gate members (shown as the first gate member 62) in the closed configuration and/or inhibit flexure of the clipper 30 mounting frame. Although shown as attached to a single gate member (member 62), another stiffener assembly may be employed with the other gate member (not shown).

When the first and second gate members 62, 64 are closed, the clip gate 66 can be laterally aligned with the centerline (CL) of the clipper 50 and upstream product horn or chute. The clipper 50 can include a clip path that directs a string of clips along a (curvilinear) rail 50*r* to a clip window 50*w*. As is well known, a punch can automatically force a forwardmost clip down the clip window 50*w* and into the clip gate 66 to cooperate with a lower forming die 88 (FIGS. 3A, 4A) to wrap the (at least one) clip around a trailing or leading gathered edge portion of a product package to close or seal the package. Generally stated, the clips are applied to the gathered packaging material to deform to wrap around and close or seal the product therein. The clip(s) can be tightly pressed to form a seal against the casing that can be sufficiently strong so as to be able to hold a vacuum of about 16 mm Hg for about 24-48 hours. Examples of suitable clips include metallic generally "U"-shaped clips available from Tipper Tie, Inc., in Apex, N.C. Other clips, including elastomeric clips or other clip materials and clip configurations may also be used.

Figure 2:
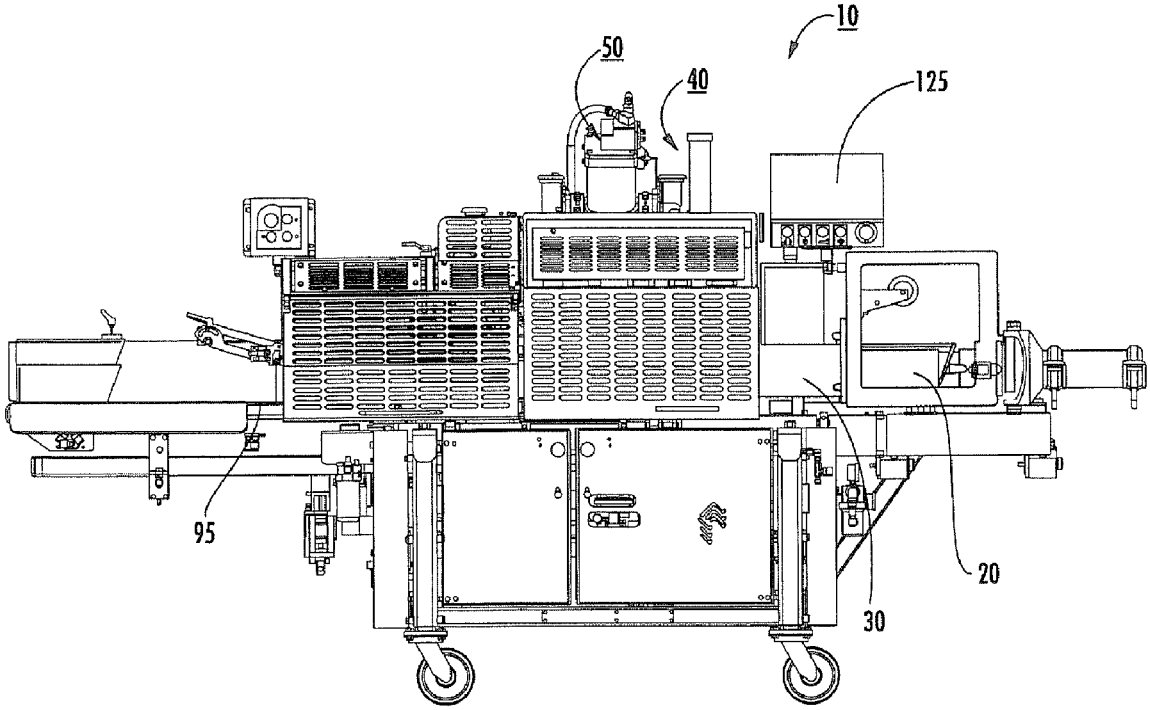
FIG. 2 is a side view of a voiding-clipping machine with a clipper apparatus according to some embodiments of the present invention.

FIG. 2 illustrates a processing system 10 that pumps product through a horn 30 and encases the product in casing material as it exits the horn 30. In operation, the encased product can be fed to the voiding/clipping apparatus 25 that can be configured to produce a series of single products or a series of chained encased products using either of the two types of casings. A clip can be applied to the beginning portion of a casing, food is pumped into the casing, and the filled casing is moved downstream from the filling point adjacent the discharge end of the horn. The filling can be interrupted momentarily while excess product is voided (pushed away from a clip zone on the package) and one clip can be applied (or two clips can be applied concurrently) to the package and/or casing at proximate but spaced apart lateral locations in the clip zone.

A knife 99 (FIG. 3A) can be automatically advanced and retracted to separate the package or casing between two concurrently applied clips to produce a sealed or closed single package. This region between the two clips is sometimes described as the "tail" or end of the package. The first or forwardmost of the two clips forms the end of the forward (first) sealed product and the second or rearwardmost of the two clips forms the beginning of the next upstream package, which is now ready for filling which is restarted.

The clippers 50 of the instant invention can be provided or used as stand-alone devices or may be provided as a part of an automated or semi-automated packaging system. The clippers can be operated to manually, semi-automatically or automatically apply closure clips to seal or hold products held in the casings and/or netting. Examples of exemplary devices and apparatus used to void, clip, package and/or tension casing material are described in U.S. Pat. Nos. 5,085,036, 5,203,760, 4,847,953; 4,675,945; 5,074,386; 5,167,567; and 6,401,885, and U.S. Patent Application Publication No. US-2005-0039419-A1, the contents of which are hereby incorporated by reference as if recited in full herein.

The target products for packaging may be a linked chain of elongated extruded product held in a casing or discrete objects held in netting or other materials. The casing can be any suitable casing (edible or inedible, natural or synthetic) such as, but not limited to, collagen, cellulose, plastic, elastomeric and/or polymeric casing.

The encased product can be a food product, such as a meat product. Exemplary meat products include, but are not limited to, strands of meat (that may comprise pepperoni, poultry, and/or beef or other desired meat), and processed meat products including whole or partial meat mixtures, including sausages, hot dogs, and the like. Other embodiments of the present invention may be directed to seal other types of food (such as cheese) or other product in casing materials or enclose the product in packaging material. Examples of other products that can be sealed in casing material include powders such as granular materials including grain, sugar, sand and the like or other flowable materials including wet (similar to that held conventionally in cans) pet food or other powder, granular, solid, semi-solid or gelatinous materials. Examples of products that can be packaged in netting or other materials also include non-pumpable items, such as, for example, bone-in or boneless hams (half, whole or other size), fresh, frozen or previously frozen turkeys (whole), and other discrete objects. The product may be packaged for any suitable industry including food, aquaculture, agriculture, environmental, chemical, explosives, or other applications.

Turning again to FIG. 2, the apparatus 10 can includes a casing forming assembly 15, a product horn 20, a controller 125 with a user input (which can be configured as a Human Machine Interface ("HMI")), a netting chute 30, a derucker 40 and a clipper assembly 50 that can include the voider 25 (FIG. 1). The apparatus 10 may also include a conveyor 95 disposed downstream of the netting chute 30. The apparatus 10 can be configured to engage a pump and filling source (not shown) disposed upstream of the horn 20. The pump can be in communication with a portioner as is known to those of skill in the art.

While described with respect to a certain type of operation, clippers of the instant invention are not limited thereto as they may be used with many different types of equipment (with non-pumpable product and chutes, with netting, without netting, with standard casings rather than heat-seal casings, and the like). In some embodiments, in operation, during the pumping process, the casing is drawn off the product horn, stuffed with product, and concurrently encased in (elastic) netting. The moisture and/or exudates(s) in the product can cause the casing to cling to the product and seal the overlapping layers of the casing together along a lower lap seal. Typically the downstream end portion of the netting and casing is clipped or closed to capture the discharged product therein. As the product is discharged from the horn 20 it expands the casing and netting to create a package shape. The netting is stretched tightly over the product with the casing therebetween. The netting can hold the package together during the cooking or other subsequent process and can provide a uniform, aesthetically appealing crosshatch pattern on the finished product. The size of the package formed can vary depending on the casing size, the length of time the filler is activated to discharge product, the tension of the netting, and/or the conveyor speed of the conveyor receiving and holding the encased product. Once the package is filled, the voider 25 of the apparatus 10 can void a target portion of the package and the clipper 50 can apply one or more clips to the voided region of the package. Typically two clips are applied and the package is severed between the clips using an automatically actuated knife 99 (FIG. 3A), as is well known to those of skill in the art. However, a series of linked products can be formed (such as a product known as "beer balls") where a single clip is placed between the linked products and two clips can be applied to stop the linked package and start another series.

The apparatus 10 can be configured to mount other horns and run different casing types, such as a heat seal horn and a shirred casing horn. Thus, the apparatus can be a multi-modal device that accepts at least two different horns, each operating using the same HMI 125 and clipper/voider assembly to allow more manufacturing adaptivity. A horn that may be configured to provide casings can be one that processes a slug-type natural or artificial casing that unwinds, advances, stretches and/or pulls to form the elongate casing over the desired product. Another type of casing is a heat-sealed tubular elastomeric casing formed by seaming a thin sheet of flexible material, typically polymeric material, together. The apparatus 10 includes a first horn 20 which cooperates with forming and sealing mechanisms held therein to convert flat roll stock material into tubular seamed casing as the material travels in the apparatus 10 and over the horn 20. Examples of tubular casing forming apparatus and an associated heat-sealing horn are described in U.S. Pat. Nos. 5,085,036 and 5,203,760, the contents of which are hereby incorporated by reference. However, as stated above, the apparatus may be a non-pumpable apparatus or may be configured to produce the tubular casings using additional and/or alternative joining or seaming means.

Figure 3A:
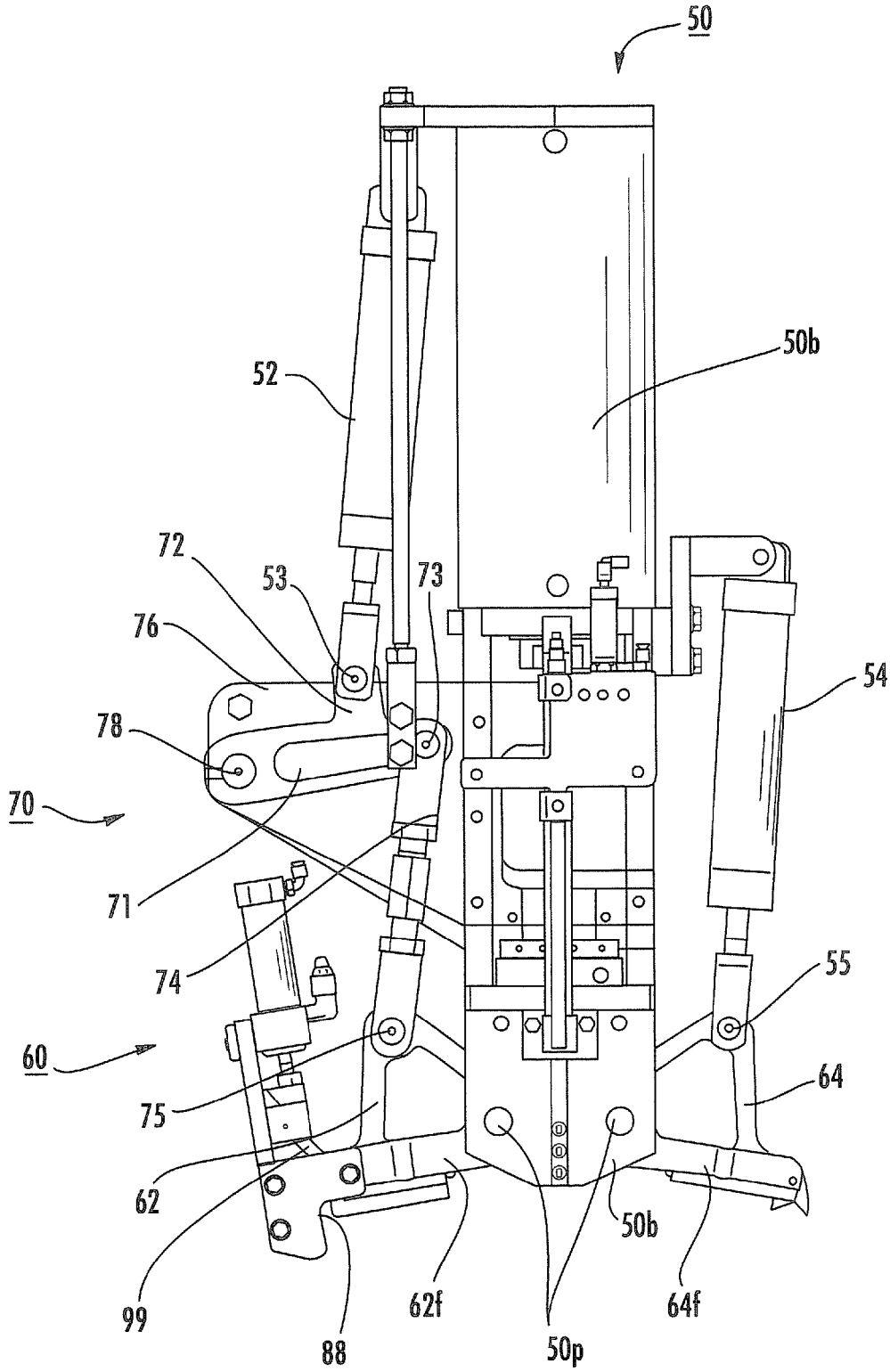
FIG. 3A is a partial end view of a clipper body with a translating gate assembly in an open configuration as shown in FIG. 1, with one mounting member shown as transparent to illustrate features of the stiffener assembly according to embodiments of the present invention.
Figure 3B:
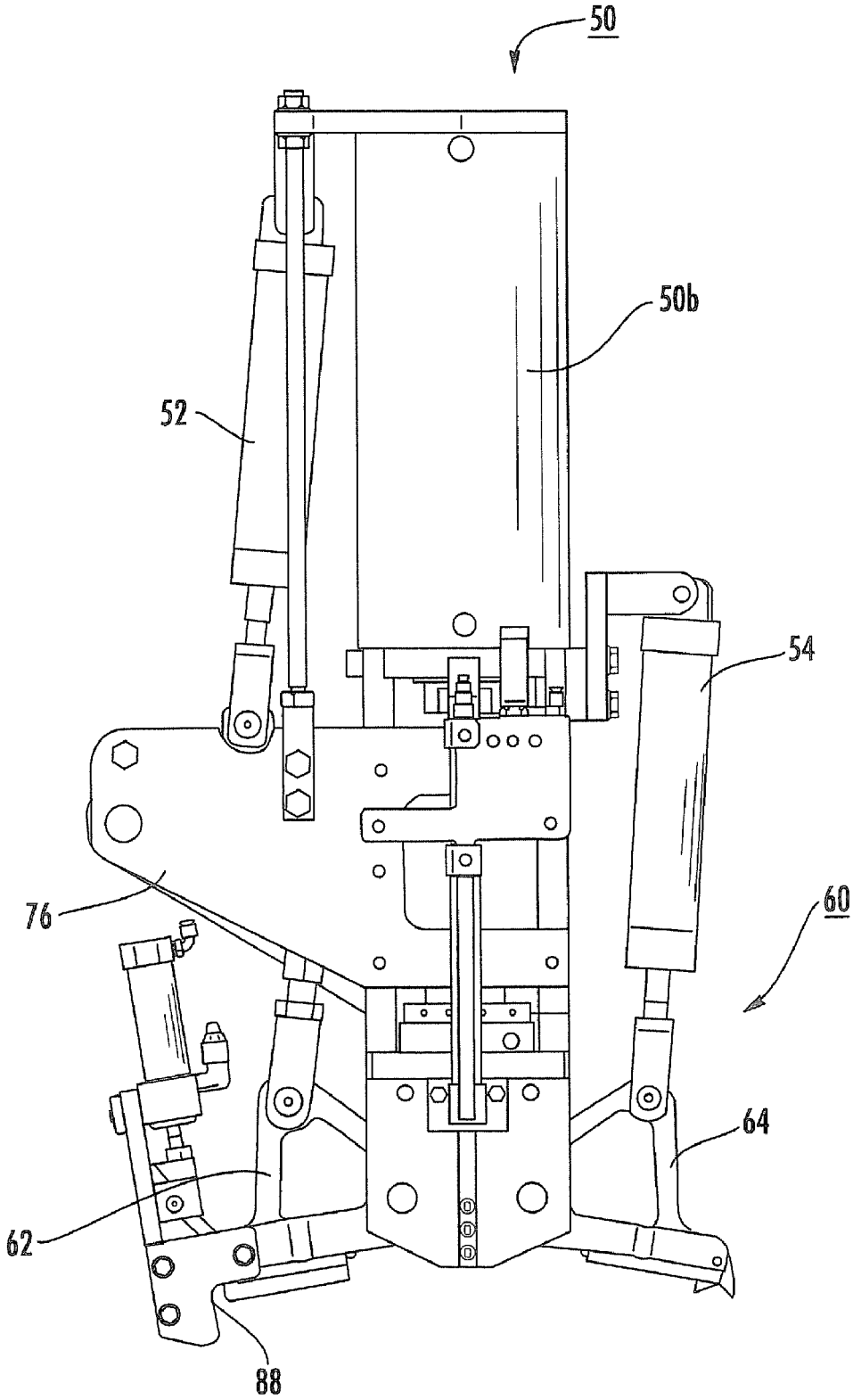
FIG. 3B illustrates the device of FIG. 3A in the open configuration, but with the transparent mounting member shown in solid lines.

Turning now to FIGS. 3A and 4A, the gate assembly 60 is shown in open and closed configurations, respectively. Referring to FIG. 3A, the stiffener assembly 70 includes a first linkage 71. The first linkage 71 includes opposing end portions with the first end portion $\mathbf{71}_1$ being pivotably attached to a stationary (fixed) mounting member 76 at pivot 78. The second end portion $\mathbf{71}_2$ is attached to a first end portion of a second linkage 74 at pivot 73. The first linkage 71 also includes an actuator attachment lobe 72 that is attached to the actuator rod 52*r* at attachment joint 53. The second linkage 74 is attached to the gate member 62 at pivot 75 at an opposing end of the linkage away from the first linkage 71. As already noted above, the gate member 62 is affixed to the (stationary) clipper body 50*b*.

In operation, the actuator 52 linearly extends rod 52*r*, forcing the first linkage 71 to pivot downward away from the clipper body 50*b*. In the embodiment shown, the first linkage 71 can pivot between about 30-75 degrees between the extended and retracted configurations, typically between about 40-60 degrees. As shown in FIG. 4A, the centerline of the first and second linkages can be substantially aligned (in a straight line) and define an angle from vertical of between about 10-60 degrees that applies a corresponding angular force Fv against the gate member 62. The applied force can have horizontal and vertical force vectors. In operation, as the gate member 62 attempts to rotate or pivot upward toward from the closed configuration, the stiffener assembly 70 can provide structural rigidity, reinforcement, stiffening or bracing.

When retracted, as shown in FIG. 3A, the second end portion of the first linkage $\mathbf{71}_2$ can reside closer to the clipper body 50*b* and direct the second linkage 74 to move closer to the clipper body 50*b* relative to the extended configuration shown in FIG. 4A.

As also shown in FIGS. 3A and 4A, the second gate member 64 is attached to the second actuator 54 and rotates into position upon linear actuation of the rod 54*r* to direct the gate member 54 to automatically travel to the closed configuration shown in FIG. 4A, then to return to the open configuration shown in FIG. 3A.

Figure 5A:
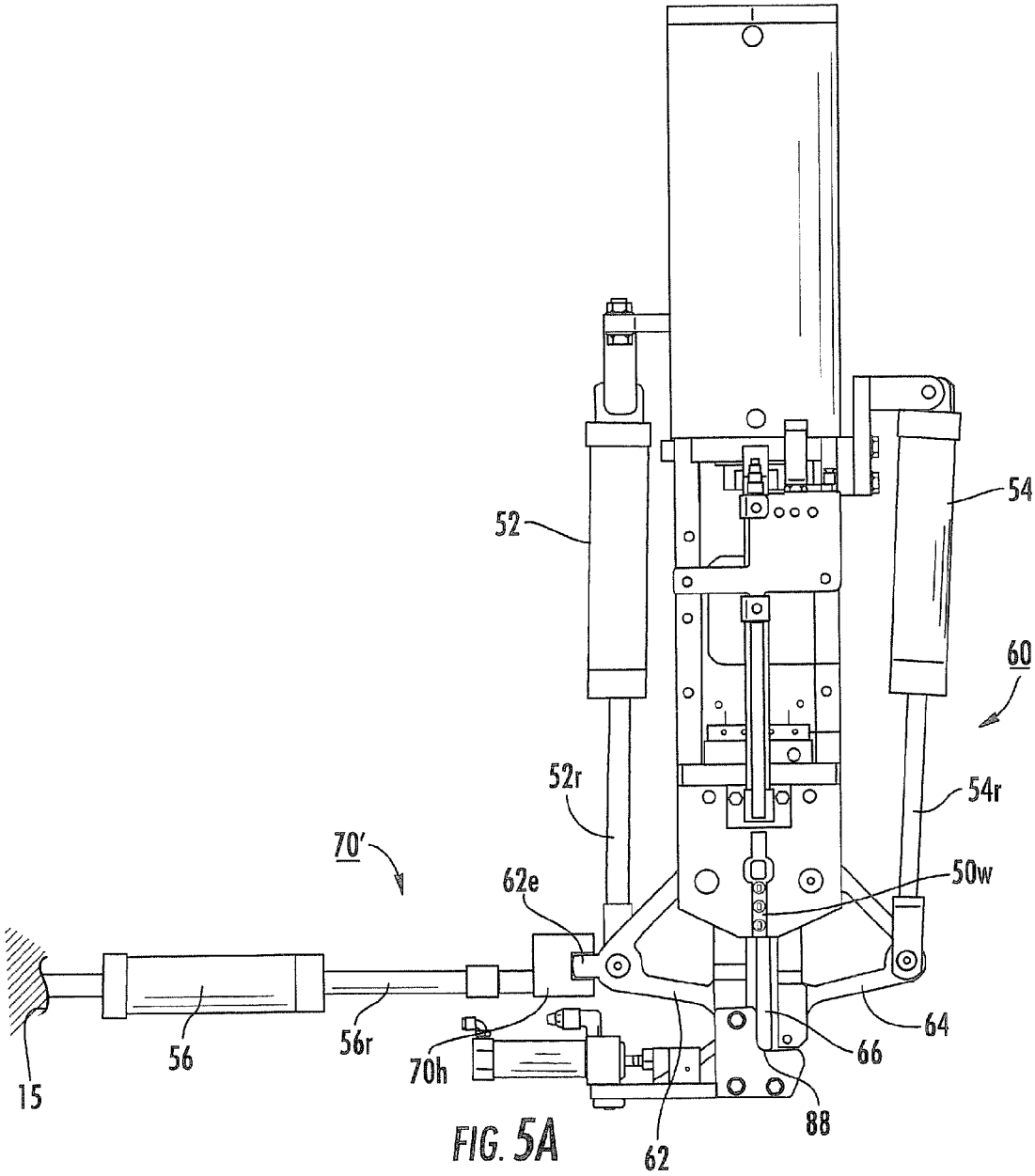
FIG. 5A is a schematic end view of the clipper of FIG. 1 and an alternative stiffener assembly according to other embodiments of the present invention.
Figure 5B:
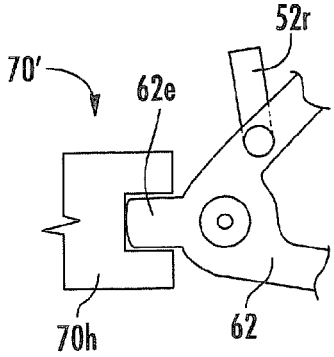
FIG. 5B is an enlarged partial view of the stiffener assembly shown in FIG. 5A.

Other stiffener assembly 70 configurations may be used and/or other mechanical structures or linkages and pivot arrangements of the stiffener assembly shown in FIGS. 3A, 4A may be employed. For example, as shown in FIG. 5A, the stiffener assembly 70' can employ a third actuator 56 with rod 56*r* that moves in laterally to contact at least one gate member 62, proximate in time to when the first and second gate members 62, 64 close together to structurally reinforce, brace or lock the gate member 62 in the closed configuration. The first and second gate members 62, 64 can be configured to close and open using the respective actuators 52, 54. Although shown as being substantially horizontal in FIG. 5A, the stiffener assembly 70' can be mounted to a frame or the clipper body at an angle, such as to define a force having an angle. FIG. 5B illustrates that the forwardmost portion of the stiffener assembly 70' can include a locking head 70*h* that releasably engages a mating portion 62*e* on the gate member 62. The head 70*h* and or portion 62*e* can be a structurally rigid material or may comprise an elastomeric, resilient elastic compressible material for grip, shock absorbancy and/or to inhibit slippage.

Figure 6:
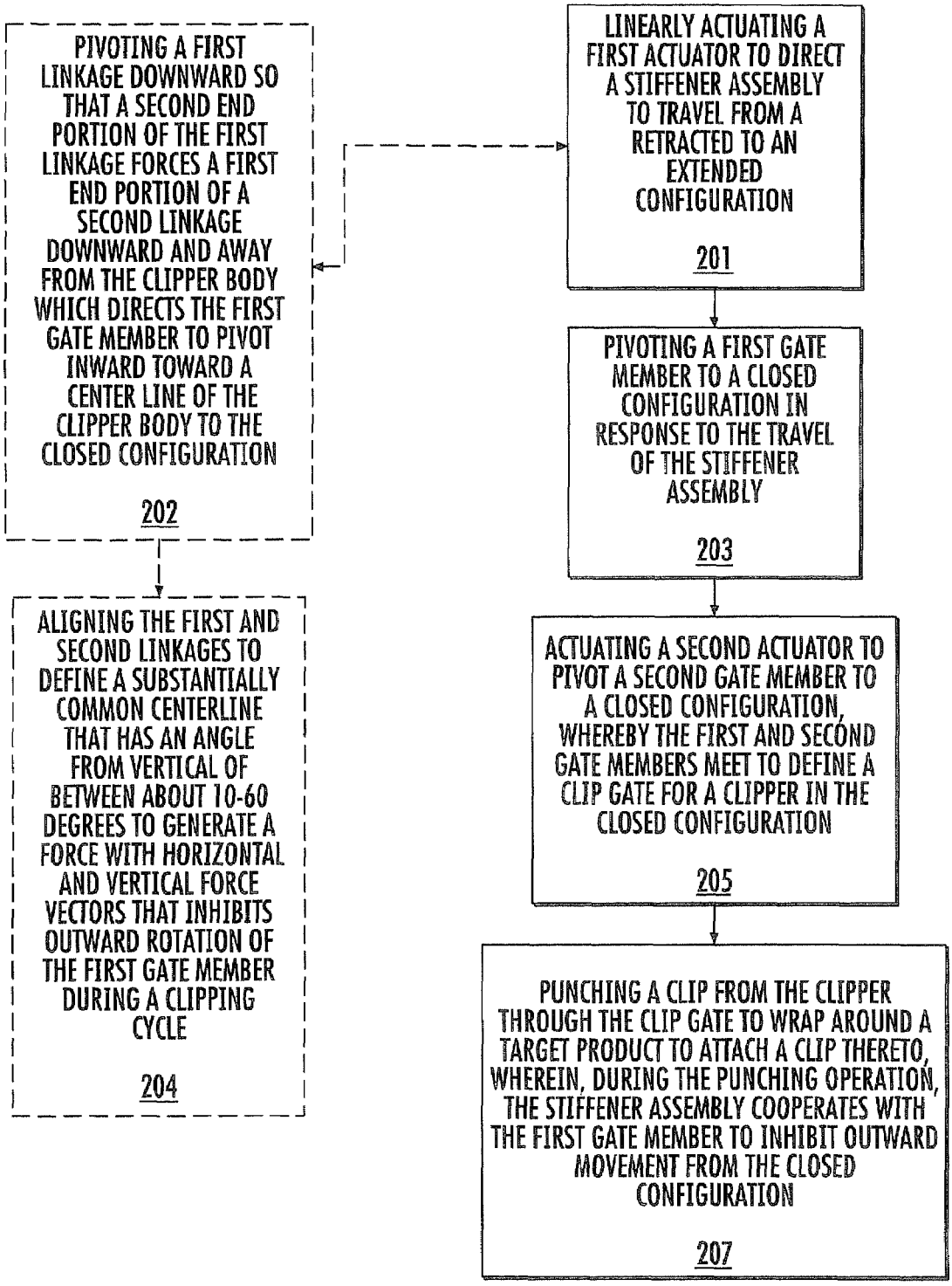
FIG. 6 is a flow chart of operations that may be carried out according to embodiments of the present invention.

FIG. 6 is a flow chart of exemplary operations that may be used to clip target articles using an automated or semi-automated clipper. A first actuator can be linearly actuated to direct a stiffener assembly to travel from a retracted to an extended configuration (block 201). A first gate member can be pivoted to a closed configuration in response to the travel of the stiffener assembly (block 203). A second actuator can be actuated to pivot a second gate member to a closed configuration whereby the first and second gate members meet to define a clip gate for a clipper in the closed configuration (block 205). Then, a clip can be punched from the clipper through the clip gate to wrap around a target product to attach a clip thereto so that, during the punching operation, the stiffener assembly cooperates with the first gate member to inhibit outward movement from the closed configuration (block 207).

Optionally, a first linkage can be pivoted downward so that the second end portion of the first linkage forces the first end portion of the second linkage downward and away from the clipper body, which directs the first gate member to pivot inward toward a center line of the clipper body to the closed configuration (block 202). The first and second linkages can be aligned to define a substantially common centerline that has an angle from vertical of between about 10-60 degrees to generate a force with horizontal and vertical force vectors that inhibits outward rotation of the first gate member during a clipping cycle (block 204).

Figure 7:
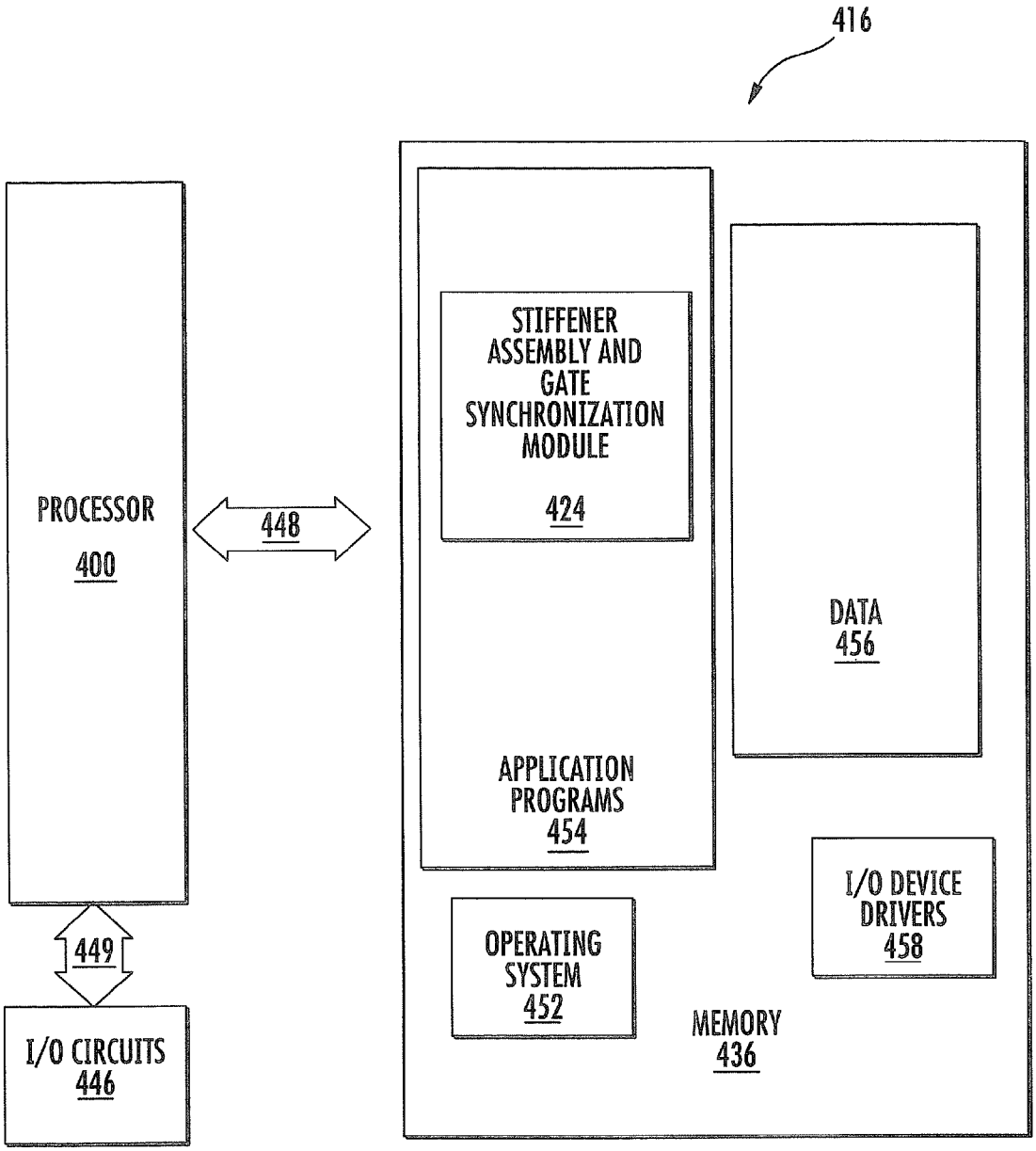
FIG. 7 is a block diagram of a data processing system according to embodiments of the present invention.

FIG. 7 is a block diagram of exemplary embodiments of data processing systems that illustrates systems, methods, and computer program products in accordance with embodiments of the present invention. The processor 400 communicates with the memory 436 via an address/data bus 448. The processor 400 can be any commercially available or custom microprocessor. The memory 436 is representative of the overall hierarchy of memory devices containing the software and data used to implement the functionality of the data processing system 416. The memory 436 can include, but is not limited to, the following types of devices: cache, ROM, PROM, EPROM, EEPROM, flash memory, SRAM, and DRAM.

As shown in FIG. 7, the memory 436 may include several categories of software and data used in the data processing system 416: the operating system 452; the application programs 454; the input/output (I/O) device drivers 458; the Stiffener Assembly and Gate Synchronization Module 424; and the data 456.

The data 456 may include a look-up chart of different casing run times (i.e., shirred slugs of casing for the second horn or tubular elastomeric (polymer) casings formed in situ, as well as the product, filling rates, selectable chain lengths and link lengths and the like corresponding to particular or target products for one or more producers. The data 456 may include data from a proximity sensor and/or exhaustion of casing material detector that allows the computer program to automatically control the operation of the apparatus to inhibit discharging product when casing material has been expended.

As will be appreciated by those of skill in the art, the operating system 452 may be any operating system suitable for use with a data processing system, such as OS/2, AIX, DOS, OS/390 or System390 from International Business Machines Corporation, Armonk, N.Y., Windows CE, Windows NT, Windows95, Windows98 or Windows2000 from Microsoft Corporation, Redmond, Wash., Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 436 components. The application programs 454 are illustrative of the programs that implement the various features of the data processing system 416 and preferably include at least one application which supports operations according to embodiments of the present invention. Finally, the data 456 represents the static and dynamic data used by the application programs 454, the operating system 452, the I/O device drivers 458, and other software programs that may reside in the memory 436.

While the present invention is illustrated, for example, with reference to the Module 424 being an application program in FIG. 7, as will be appreciated by those of skill in the art, other configurations may also be utilized while still benefiting from the teachings of the present invention. For example, the Module 424 may also be incorporated into the operating system 452, the I/O device drivers 458 or other such logical division of the data processing system 416. Thus, the present invention should not be construed as limited to the configuration of FIG. 7, which is intended to encompass any configuration capable of carrying out the operations described herein.

The I/O data port can be used to transfer information between the data processing system 416 and the voider or upstream product preparation system 420 or another computer system or a network (e.g., the Internet) or to other devices controlled by the processor. These components may be conventional components such as those used in many conventional data processing systems which may be configured in accordance with the present invention to operate as described herein.

While the present invention is illustrated, for example, with reference to particular divisions of programs, functions and memories, the present invention should not be construed as limited to such logical divisions. Thus, the present invention should not be construed as limited to the configuration of FIG. 7 but is intended to encompass any configuration capable of carrying out the operations described herein.

The flowcharts and block diagrams of certain of the figures herein illustrate the architecture, functionality, and operation of possible implementations of selective implementation of single and dual clip closure means according to the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A clipper, comprising:

a clipper with a clipper body having a stationary mounting member that projects outwardly laterally away from the clipper body; and a translating gate assembly adapted to cooperate with the clipper, comprising:

a first gate member configured to automatically translate between open and closed configurations;

a second gate member configured to automatically translate between open and closed configurations, wherein when the first and second gate members are in the respective closed configurations, the first and second gate members meet to define a clip entry gate for clips delivered from the clipper; and a stiffener assembly attached to the first gate member, the stiffener assembly configured to translate between a retracted and an extended configuration, wherein the stiffener assembly comprises an upper first linkage attached to a lower second linkage, the first linkage pivotably attached to the stationary mounting member of the clipper body and to a lower portion of an actuation rod whereby actuation of the rod pivots the first linkage downward and causes the first and second linkages to align to have a substantially common centerline that is at an angle from vertical of between about 10-60 degrees to provide a stiffener closure force against the first gate member in the closed configuration.

2. A clipper according to claim 1, whereby actuation of the rod to a retracted configuration pivots the first linkage upward, which causes a first end portion of the second linkage to move upward and inward thereby misaligning the first and second linkages and pulling the first gate open.

3. A clipper according to claim 1, wherein the first linkage has opposing first and second end portions with the first end portion of the first linkage being pivotably attached to the stationary mounting member of the clipper body and the second end portion of the first linkage being pivotably attached to an upper first end portion of the second linkage, and wherein a lower portion of the second linkage is attached to the first gate member, and wherein the actuator rod is attached to the first linkage between the first and second end portions, whereby, in operation, the actuator automatically directs the first linkage to pivot downwardly whereby the second linkage translates downwardly so that the first and second linkages have the substantially common centerline when the stiffener assembly is in the extended configuration.

4. A clipper, comprising:

a clipper with a clipper body having a stationary mounting member attached to the clipper body, wherein the stationary mounting member projects outwardly laterally away from the clipper body and is affixed to the clipper body; and a translating gate assembly adapted to cooperate with the clipper, comprising:

a first gate member configured to automatically translate between open and closed configurations;

a second gate member configured to automatically translate between open and closed configurations, wherein when the first and second gate members are in the respective closed configurations, the first and second gate members meet to define a clip entry gate for clips delivered from the clipper; and a stiffener assembly attached to the first gate member, the stiffener assembly configured to translate between a retracted and an extended configuration, wherein the stiffener assembly comprises:

a first linkage with opposing first and second end portions with the first end portion of the first linkage being pivotably attached to the stationary mounting member, and an intermediate portion of the first linkage is attached to an actuation rod of an actuator, a second linkage with opposing first and second end portions with the first end portion attached to the second end portion of the first linkage and the second end portion is pivotably attached to the first gate member, whereby, in operation, the actuator automatically directs the first linkage to pivot downwardly, which, in turn causes the second linkage to translate downwardly so that the first and second linkages have a substantially common centerline when the stiffener assembly is in the extended configuration whereby the stiffener assembly applies a closing force against the closed first gate member sufficient to inhibit outward movement of the first gate member during a clipping operation.

5. A clipper according to claim 4, wherein the first linkage is attached to the stationary mounting member at a location that is above the first and second gate members and laterally outside a line drawn from an outside boundary of the first gate member when the first gate member is in the closed configuration.

6. A clipper according to claim 4, whereby actuation of the rod to a retracted configuration pivots the first linkage upward, which causes the first end portion of the second linkage to move upward and inward thereby misaligning the first and second linkages and pulling the first gate open.

7. A clipper according to claim 4, wherein the first linkage comprises a lobe actuator mount portion residing between the first end portion and the second end portion, and wherein the actuation rod is attached to the lobe actuator mount portion whereby actuation of the rod pivots the first linkage downward and causes the first and second linkages to be aligned with the substantially common center line oriented at an angle from vertical of between about 10-60 degrees.

8. A clipper with a translating gate assembly, comprising:

an automated or semi-automated clipper with an upstanding clipper body having an outwardly projecting stationary mounting member;

a first gate member attached to the clipper body operatively associated with a first actuator configured to translate between open and closed configurations;

a second gate member attached to the clipper body operatively associated with a second actuator configured to automatically translate between open and closed configurations, wherein when the first and second gate members are in the respective closed configurations, the first and second gate members meet to define a clip entry gate for clips delivered from the clipper; and a stiffener assembly attached to the clipper body and the first gate member, the stiffener assembly configured to translate between a retracted and an extended configuration, wherein the stiffener assembly comprises:

an upper first linkage having opposing first and second end portions with the first end portion of the first linkage being pivotably attached to the stationary mounting member; and a lower second linkage having opposing first and second end portions, the first end portion of the second linkage being pivotably attached to the second end portion of the first linkage and the second end portion of the second linkage being pivotably attached to the first gate member, whereby, in operation, the first actuator extends downwardly to pivot the first linkage downward, which causes the second linkage to travel downward so that the first and second linkages are aligned and reside at an angle that is between about 10-60 degrees from vertical to thereby apply a stiffening force against the closed first gate member sufficient to inhibit outward movement of the first gate member from the closed configuration during a clipping operation.

9. A clipper according to claim 8, wherein the first end portion of the first linkage is affixed to the stationary mounting member at a location that is above the first and second gate members and outside a line drawn from an outside boundary of the first gate member when the first gate member is in the closed configuration.

10. A clipper according to claim 8, wherein the first linkage comprises a lobe actuator mount portion residing between the first and second end portions of the first linkage, with a lower portion of an actuation rod of the first actuator attached to the lobe actuator mount portion whereby actuation of the rod to an extended configuration pivots the first linkage downward and causes the first and second linkages to be substantially axially aligned, and whereby actuation of the rod to a retracted configuration pivots the first linkage upward which causes the first end portion of the second linkage to move upward and inward thereby misaligning the first and second linkages and pulls the first gate open.

11. A method of clipping target articles using an automated or semi-automated clipper, comprising:

automatically downwardly extending a first actuator attached to a first linkage to an extended configuration;

pivoting the first linkage attached to the first actuator and a stationary mounting member projecting outwardly a distance from a clipper body, in response to the downwardly extending step;

forcing a second linkage attached to the first linkage and a first gate member downward to a closed configuration;

actuating a second actuator to pivot a second gate member to a closed configuration, whereby the first and second gate members meet to define a clip gate for the clipper in the respective closed configurations; then punching a clip from the clipper through the clip gate to wrap around a target product to attach a clip thereto, wherein, during the punching, the first and second linkages are aligned and oriented at between about a 10-60 degree angle from vertical to inhibit outward movement of the first gate member from the closed configuration; then automatically retracting the first actuator upward to pivot the first linkage upward; and forcing the second linkage to translate upward in response to the retracting step so that the first gate member is in an open configuration and centerlines of the first and second linkages are misaligned.

12. A method according to claim 11, wherein the clipper is a non-pivoting clipper.

* * * * *